US006303664B1

(12) United States Patent
Sonnenberg et al.

(10) Patent No.: US 6,303,664 B1
(45) Date of Patent: Oct. 16, 2001

(54) TREATMENT FOR REDUCING RESIDUAL CARBON IN THE LOST FOAM PROCESS

(75) Inventors: Fred Sonnenberg, Forth Worth, TX (US); Kyösti Matti Taristo, Haarajooki; Tom Verner Johannes Johansson, Borgå, both of (FI)

(73) Assignee: StyroChem Delaware, Inc., Wilmington, DE (US)

( * ) Notice: Subject to any disclaimer, the term of this patent is extended or adjusted under 35 U.S.C. 154(b) by 0 days.

(21) Appl. No.: 09/430,544

(22) Filed: Oct. 29, 1999

(51) Int. Cl.[7] ..... C08J 9/18; B22C 7/00; B22C 1/22

(52) U.S. Cl. ..... 521/56; 164/45; 164/523; 164/524; 164/526; 164/34; 521/98; 521/907

(58) Field of Search ..... 521/56, 98, 907; 164/45, 34, 523, 524, 526

(56) References Cited

U.S. PATENT DOCUMENTS

| | | | | |
|---|---|---|---|---|
| 3,572,421 | | 3/1971 | Mezey et al. | 164/237 |
| 3,755,209 | | 8/1973 | Nintz et al. | 260/2.5 B |
| 3,842,899 | | 10/1974 | Hauser-Lienhard | 164/253 |
| 3,861,447 | | 1/1975 | Hondo | 164/34 |
| 3,975,327 | * | 8/1976 | Nintz et al. | 521/60 |
| 4,028,285 | | 6/1977 | Pillar | 260/2.5 B |
| 4,113,672 | | 9/1978 | Pillar | 521/60 |
| 4,281,067 | | 7/1981 | Kienzle et al. | 521/56 |
| 4,286,071 | | 8/1981 | Rigler et al. | 521/96 |
| 4,407,977 | * | 10/1983 | Rigler et al. | 521/58 |
| 4,448,235 | | 5/1984 | Bishop | 164/34 |
| 4,482,000 | | 11/1984 | Reuter | 164/34 |
| 4,609,512 | * | 9/1986 | Rigler et al. | 521/56 |
| 4,612,968 | | 9/1986 | Aston et al. | 164/34 |
| 4,618,468 | * | 10/1986 | Rigler et al. | 521/56 |
| 4,763,715 | | 8/1988 | Cannarsa et al. | 164/45 |
| 4,773,466 | | 9/1988 | Cannarsa et al. | 164/45 |
| 4,874,030 | * | 10/1989 | Kuphal et al. | 521/134 |
| 4,927,858 | | 5/1990 | Joyce et al. | 521/59 |
| 4,933,412 | | 6/1990 | Itoh et al. | 524/466 |
| 4,994,499 | | 2/1991 | Sonnenberg et al. | 521/56 |
| 5,403,866 | * | 4/1995 | Kato et al. | 521/134 |

* cited by examiner

*Primary Examiner*—Morton Foelak
(74) *Attorney, Agent, or Firm*—Duane Morris

(57) ABSTRACT

The evaporative casting of molten metals has been shown to produce castings having smooth surfaces with significantly less signs of carbon deposits thereon by using an expandable vinyl aromatic polymer containing a bromine-attached aliphatic or aromatic flame retardant.

19 Claims, No Drawings

TREATMENT FOR REDUCING RESIDUAL CARBON IN THE LOST FOAM PROCESS

FIELD OF INVENTION

The present invention is directed to an improved process for producing metal castings using the lost foam casting process.

BACKGROUND OF THE INVENTION

Lost Foam Casting (Full Mold Casting) involves placing a plastic pattern of the desired cast part in sand and then pouring molten metal onto the plastic casting causing it to vaporize. The molten metal exactly reproduces the plastic pattern to provide the ultimate casting.

It is known that polystyrene, the major polymer used in this application, produces surface defects when casting iron due to carbon residues left by the polymer. When casting low carbon steel the carbon formed from the polystyrene dissolves in the metal degrading the properties of the cast part. A number of patents describe variations in the Lost Foam Casting process that are intended to minimize the residues left by the polymer after the metal has been poured. Most of these variations involve changing the coating on the pattern or changing the flask in which the casting is made. For example, U.S. Pat. Nos. 4,448,235 and 4,482,000 describe a variable permeability casting designed to avoid entrapment of polymer vapors in the casting. U.S. Pat. No. 3,572,421 describes a flask containing many air breathing holes to allow the escape of polymer degradation products to decrease the formation of carbon. Similarly, U.S. Pat. Nos. 3,842,899, 3,861,447, and 4,612,968 describe the addition of vacuum to the casting flask to aid in the removal of the polymer residues.

The Dow Chemical Company has reported the development of a polymethyl methacrylate foam bead useful to replace polystyrene for the casting process. (Moll and Johnson, "Eliminate the Lustrous Carbon Defect with New Moldable Foam", Evaporative Foam Casting Technology II Conference, Nov. 12–13, 1986, Rosemont, Ill.). Although this polymer reduces residues left on the cast part, it carries with it other disadvantages. The higher glass transition temperature (130° C.) of the polymer causes longer molding cycles when preparing patterns. It uses a Freon blowing agent which has been shown to cause corrosion of molds. It also rapidly gives off a large volume of gas when castings are made. It is very difficult to control the evolution of gas and often the molten metal is blown back out of the flask.

There is still a great need for a polymer that provides the advantages of polystyrene but produces no carbon defects. U.S. Pat. Nos. 4,773,466 and 4,763,715 teach the use of polycarbonate copolymers and terpolymers, respectively, to make patterns for the lost foam casting process. The molded patterns need to be made at a higher density compared to EPS to retain the needed physical properties for a successful casting.

The manufacture of molded articles from expanded thermoplastic polymer particles such as expandable polystyrene beads (EPS) is well known. Two methods are commonly used for preparing molded products from vinyl aromatic monomers. In one method, called herein "the two-step process," the vinyl aromatic monomer, typically styrene, is suspension polymerized to form hard polymer beads, which are isolated and screened to the desired bead size distribution. The sieved polystyrene beads are then resuspended in water, impregnated with a blowing agent—optionally in the presence of a flame retardant, pre-expanded with steam, aged, and molded. This process is illustrated by the teachings of U.S. Pat Nos. 4,028,285 and 4,113,672. In another method, called herein the "one-step process," the vinyl aromatic monomer is suspended-often in the presence of a flame retardant-and with a blowing agent, the partially polymerized mixture is cured without isolation or screening of the beads as in the two-step process. The one-step process for making expandable beads is illustrated by the teachings of U.S. Pat. Nos. 3,755,209, 3,975,327, 4,281,067 and 4,286,071. While the one-step method is simpler, the beads produced tend to have a wider bead size distribution. The method of the present invention encompasses the "one-step process."

In a one-step process the polymerization of styrene can be carried out using benzoyl peroxide as an initiator. The suspension process is carried out in water in a stirred reactor using tricalcium phosphate (TCP) as a suspending agent and Nacconol (sodium dodecyl benzenesulfonate) as a surfactant to keep the styrene droplets from coalescing when they form discrete particles of polystyrene beads. Other systems employ potassium persulfate as an extender. A flame retardant is optionally added and a secondary initiator such as dicumyl peroxide (DiCup), t-amyl peroxy-2-ethylhexyl carbonate (TAEC) or t-butyl peroxy-2-ethylhexyl carbonate (TBEC) is used to reduce the unreacted styrene to less than 1000 ppm in a secondary cure cycle.

At about 70 to 80% conversion of the styrene to polystyrene, pentane as the blowing agent is added over a period of time. Afterward, the second stage of curing occurs at elevated temperatures to finish the polymerization of styrene to polystyrene. The impregnated beads are commonly known as EPS.

An object of the present invention is to completely eliminate carbon defects in lost foam castings. A box pattern is molded from EPS (expandable polystyrene) prepuff, conditioned, and coated with a ceramic finish. The coated EPS patterns are glued in clusters to a sprue which is then placed in a flask, and sand is compacted around it. The box pattern is gated to allow the converging metal, Aluminum 319 alloy at 1350° F., to fill the patterns. The placement of the gating in the box pattern is done to maximize fold defects from converging metal fronts in the casting.

DETAILED DESCRIPTION OF THE INVENTION

We have now developed a process for the preparation of a vinyl aromatic polymer, e.g., an expandable polystyrene suitable for Lost Foam casting applications. Pre-expanded beads (prepuff) prepared from styrene in a "one-step process" containing an effective amount of a bromine-attached aliphatic or aromatic flame retardant can be used in conventional steam molding equipment to produce low density patterns. Aluminum castings made from the polystyrene/flame retardant material show significantly less signs of lustrous carbon defects, although any metal may be benefited by the technology of the present invention. The polystyrene smoothly and controllably decomposes to give a smooth, clean metal casting.

The vinyl aromatic polymer particles suitable for use in the process of this invention may be spherical or irregularly shaped particles of any of the thermoplastic vinyl aromatic polymers usable in the preparation of molded foam articles. Although homopolymers or copolymers of any vinyl aromatic monomer may be employed, styrene and substituted styrene monomers are preferred. Examples of suitable vinyl aromatic monomers include, but are not limited to, styrene, -methyl styrene, aryl-methyl styrene, aryl-ethyl styrene, aryl-isopropyl styrene, aryl-tert-butyl styrene, vinyl toluene, vinyl xylene, aryl-chlorostyrene, aryl-chloromethylstyrene, vinyl napthalene, divinyl benzene, and the like. Minor amounts (i.e., up to about 50 mole percent) of other ethylenically unsaturated copolymerizable monomers may also be used, including, for example, butadiene, acrylic acid, methacrylic acid, maleic anhydride, methyl methacrylate, acrylonitrile, and the like. The vinyl aromatic polymer may be rubber modified with an elastomer such as polybutadiene or styrene/butadiene block or random copolymers. The vinyl aromatic polymer particles should preferably be from about 0.1 to 2 mm in average diameter. Methods of obtaining suitable particles such as suspension polymerization or pelletization are well known in the art.

The polymers useful in the present invention include polystyrene having a molecular weight of 150,000 to 350,000, preferably from about 170,000 to 320,000. Small spherical beads of polymer having bead diameters between 100 and 600 microns, preferably between 200–500 microns, and most preferably between 250–425 microns are useful for purposes of the present invention.

Thus, the present invention is directed to a process for preparing a pattern for use in making metal castings (e.g., brass, bronze, ductile, modular or grey iron, magnesium or steel) which have significantly less residual carbon on the surface, which comprises:

(a) adding an amount, effective for the purpose, of a bromine-attached aliphatic or aromatic flame retardant to a vinyl aromatic monomer such as styrene;

(b) suspending the styrene in water using a suitable suspending agent system;

(c) adding a suitable blowing agent to the partially polymerized suspension and heating to impregnate the particles; and (d) separating the impregnated beads from the aqueous suspension, washing and drying the beads.

By bromine-attached aliphatic or aromatic flame retardant, it is meant an organic bromine compound having more than 40% by weight bromine and not more than 80% by weight bromine.

Five commonly used flame retardants used in the modified grade of EPS are shown in Table 1 below. The flame retardants are incorporated usually in levels less than 1.0 wt %. In some cases, a relatively high temperature peroxide, such as dicumyl peroxide (DiCup), is added during the styrene polymerization cycle along with the flame retardant. DiCup acts as a synergist and allows the use of less flame retardant while giving the same level of protection during a fire. Other organic peroxides can be used if the decomposition half-life is greater than 2 hours at 100° C., for instance, Vulcup R [ , '-bis (t-butyl peroxy) diisopropyl-benzene].

TABLE 1

| Product | Chemical Name | Requires Synergist |
|---|---|---|
| A | Tetrabromocyclooctane | DiCup |
| B | Dibromoethyl dibromocyclohexane | DiCup |
| C | Hexabromocyclododecane | DiCup |
| D | Tetrabromophenol A bis(allyl ether) | None |
| E | 2,4,6-Tribromophenyl allyl ether | None |

While one of the purposes of the flame retardant in EPS is to generate HBr while being heated at elevated temperatures, a more important function is to generate free radicals which reduce the polystyrene molecular weight so that the material quickly can liquefy. This can be verified by running melt index experiments using ASTM D-1238, run under condition G using a weight of 4900 at 200° C. with and without flame retardants. In the presence of certain flame retardants or peroxides, the melt flow of the extrudate will come out like water, while the control will flow like molasses.

A number of brominated fire retardant materials are effective for purposes of the present invention. Hexabromocyclododecane (HBCD) to be used as the fire-retardant agent in the process of this invention can be any of the hexabrominated derivatives of cyclododecatriene. Any of the isomers of hexabromocyclododecane are suitable for use. Mixtures of different isomers of hexabromocyclododecane can also be employed. HBCD is available commercially from Ameribrom, Inc., Albemarle Corp. ("SAYTEX HBCD"), and Great Lakes Chemical Corp. ("CD-75P").

From about 0.2 to 1.2 parts by weight of the HBCD per 100 parts by weight of the styrene is preferably present in the aqueous suspension. Most preferably, the level of HBCD is from about 0.4 to 0.8 parts per weight per 100 parts by weight of the styrene. However, it can be envisioned that a range of up to 2.5 weight % flame retardant may be required in certain instances to reduce the carbon defects to an insignificant amount.

Suitable blowing agents are, e.g., butane, n-pentane, isopentane, cyclopentane, hexane, carbon dioxide, fluorinated hydrocarbons and mixtures thereof.

Examples of suitable suspending agents include finely divided water-insoluble inorganic substances such as tricalcium phosphate, zinc oxide, bentonite, talc, kaolin, magnesium carbonate, aluminum oxide, and the like as well as water-soluble polymers such as polyvinyl alcohol, partially hydrolyzed polyvinyl acetate, hydroxyethyl cellulose, polyacrylic acid, methyl cellulose, polyvinyl pyrrolidone, and the like. An anionic surfactant extender such as a sodium linear alkylbenzene sulfonate (preferably, from about 0.001 to 0.10 parts by weight per 100 parts by weight vinyl aromatic monomer) may also be employed. Such extenders are described, for example, in U.S. Pat. No. 2,673,194. The use of tricalcium phosphate together with a sodium linear alkylbenzene sulfonate is particularly preferred. The amount of suspending agent necessary to form a stable suspension of the vinyl aromatic polymer particles in the water will vary depending on a number of factors, but will generally be from about 0.1 to 5 parts by weight per 100 parts by weight of the vinyl aromatic polymer particles. One or more nonionic surfactants such as a polyoxyalkylene derivative of sorbitan monolaurate or other fatty acid ester or an ethylene oxide/propylene oxide block copolymer, can also be added to the aqueous suspension if desired. The preferred amount of nonionic surfactant is from about 0.01 to 1 part by weight per 100 parts by weight vinyl aromatic polymer particles.

The aqueous suspension is heated, preferably while stirring or mixing, at a temperature of from about 40° C. to 140° C. (preferably, from about 80° C. to 130° C.) for a period of from about 0.5 to 15 hours (preferably, from about 1 to 5 hours) until the hexabromocyclododecane and the aliphatic hydrocarbon foaming agent are incorporated into the vinyl aromatic polymer particles. The temperature may advantageously be varied during this polymerization step.

Following impregnation and the secondary curing stage, the fire-retardant expandable vinyl aromatic polymer beads are separated from the water using an appropriate method such as filtration, centrifugation, or decantation. The beads may be washed with additional water and then dried, if desired. If a suspending agent such as tricalcium phosphate is used, it may be desirable to first wash the beads with dilute acid (hydrochloric acid, for example) to remove the suspending agent.

The fire-retardant expandable vinyl aromatic polymer beads produced by the process of this invention may be readily shaped into molded foam articles by heating in molds which are not gastight when closed. The beads expand in steam to form prepuff which after aging can be fused together to form the molded article. Such methods of preparing molded-bead foams are well-known and are described, for example, in Ingram et al, "Polystyrene and Related Thermoplastic Foams" *Plastic Foams,* Marcel Dekker (1973), Part II, Chapter 10, pp.531–581, Ingram "Expandable Polystyrene Processes" *Addition and Condensation Polymerization Process* American Chemical Society (1969), Chapter 33, pp. 531–535.

Molded foam articles prepared using the fire-retardant expandable vinyl aromatic beads of this invention are resistant to flame, even when relatively low levels of the hexabromocyclododecane and other suitable flame retardants are present. The hexabromocyclododecane is incorporated within the beads rather than coated on the surface of the beads and thus does not interfere with the fusion of the beads when they are expanded into molded foam articles. The density, tensile strength, heat resistance and other physical and mechanical properties of the foams are unaffected by the presence of the hexabromocyclododecane if the process of this invention is employed.

Without further elaboration, it is believed that one skilled in the art can, using the preceding description, utilize the present invention to its fullest extent. The following examples, therefore, are to be considered as merely illustrative and are not limitative of the claims or remainder of the disclosure in any way whatsoever.

EXAMPLES

The general procedure for making the material associated with the present invention was as follows: 226 pounds of water and 226 pounds of styrene were added to a 50 gallon reactor being stirred at 160 RPM; 217 g of TCP, 1.22 g of Nacconol, 205 g of Polywax 1000 (a polyethylene wax), 718 g of HBCD, 379 g of 75% benzoyl peroxide, 308 g of DiCup, and 113 g of t-butyl peroxy-2-ethylhexyl carbonate (TBEC) were then added.

The reactor was heated from room temperature to 194° F. and kept at this temperature for 6 hours. At 5 hours and 45 minutes, 18.1 pounds of water, 205g of TCP and 1.29 g of Nacconol was added. The reactor was sealed and purged with nitrogen three times. The reactor was heated to 203° F. and a mixture of 14.4 pounds of n-pentane and 3.6 pounds of iso-pentane was added over a period of 70 minutes at a rate of one pound per 4 minutes.

The reactor was heated to 262° F. at a rate of 1° F./minute and kept at this temperature for two hours and 15 minutes. The reactor was then cooled to 100° F. and the contents were emptied into a batch out tank containing water and HCl. The contents were acidified to a pH of about 2.0 to remove TCP. The beads were dried by passing them through a dryer and screened to remove any agglomerated beads. Each hundred pounds of dry beads were then treated with 10 grams of silicone oil.

EPS box patterns were molded from the EPS beads. The EPS parts were conditioned and then dipped into a ceramic coating. After drying, the parts were glued in clusters to a sprue and then placed in a flask. Sand was compacted around them. Aluminum 319 alloy was poured into the patterns at 1350° F. and afterward, the parts were examined for folds.

| Sample | Flame Retardant | Synergist | Average Fold Area $mm^2$ |
|---|---|---|---|
| 1–13 | HBCD (0.68 wt. %) | DiCup (0.3 wt. %) | 0 |
| 14 | HBCD (0.68 wt. %) | DiCup (0.3 wt. %) | 15 |
| 15–20 | HBCD (0.68 wt. %) | DiCup (0.3 wt. %) | 0 |
| Average | 1 | | |
| Control | | | |
| 1 | None | None | 3 |
| 2 | None | None | 5 |
| 3 | None | None | 70 |
| 4 | None | None | 0 |
| 5 | None | None | 10 |
| 6 | None | None | 20 |
| 7 | None | None | 12 |
| 8 | None | None | |
| Average | | | 17 |

T170B is a commercially available expandable polystyrene bead which is used for lost foam production. The EPS bead, created in a two-step process, has a molecular weight of approximately 240,000, a bead size distribution ranging from 250 to 500 microns, and a pentane blowing agent.

Of the eight box patterns made using the T-170B materials, only one had no folds when poured with aluminum. The average fold surface area was 17 $mm^2$. Two samples had minor folds, four had a typical fold area, and one had a particularly significant fold area (Control 3).

EPS does not depolymerize cleanly back to 100% monomeric styrene. The amount varies from 70 to 75% depending on the actual conditions of depolymerization at 400° C. Thus, each time decomposition of the polystyrene occurs, the results will be different in terms of the amount of gases, styrene, and other liquid and solid residues being generated. At higher temperatures used for pouring aluminum, the amount of styrene decreases and the formation of carbon, methane, and hydrogen are prevalent.

In contrast, of the 20 box patterns made from polystyrene beads containing HBCD, only one of the twenty patterns had any folds. The average fold surface area was only 1 $mm^2$. The reason that the fold area has significantly decreased may be attributed to the action of the flame retardant which allows for a complete breakdown of polystyrene into liquid products faster and more consistently than if no additive were used. This allows for the decomposition products, liquids and gases to pass through the coating into the sand more controllably and efficiently during the metal pour resulting in converging metal fronts having virtually no carbon defects due to folds.

While this invention has been described with respect to particular embodiments thereof, it is apparent that numerous other forms and modifications of this invention will be obvious to those skilled in the art. The appended claims in this invention generally should be construed to cover all such obvious forms and modifications which are within the true spirit and scope of the present invention.

We claim:

1. A process for preparing a pattern for use in making metal castings which have significantly less residual carbon on the surface comprising:

(a) adding an amount, effective for the purpose, of a hexabromocyclododecane or tetrabromocyclooctane flame retardant to a vinyl aromatic monomer;

(b) suspending the monomer in water using a suitable suspending agent system;

(c) adding a suitable blowing agent to the partially polymerized suspension and heating to impregnate the particles; and (d) separating the impregnated beads from the aqueous suspension, washing and drying the beads, wherein said surface is selected from the group consisting of bronze, brass, ductile, modular or grey iron, magnesium and steel.

2. The process as recited in claim 1 wherein the resulting vinyl aromatic polymer has a molecular weight of about 170,000 to 320,000.

3. The process as recited in claim 1 wherein the resulting vinyl aromatic polymer has a bead size between about 100 and 600 microns.

4. The process as recited in claim 1 wherein the resulting vinyl aromatic polymer has a bead size between 150 and 500 microns.

5. The process as recited in claim 1 wherein the resulting vinyl aromatic polymer has a bead size between about 250 and 425 microns.

6. The process as recited in claim 1 wherein the flame retardant is selected from the group consisting of hexabromocyclododecane, 2,4,6-tribromophenyl allyl ether, dibromoethyl dibromocyclohexane, tetrabromocyclooctane, and tetrabromophenol A bis (allyl ether).

7. The process as recited in claim 1 wherein organic peroxides are used if the decomposition half-life is greater than 2 hours at 100° C., and wherein the organic peroxides are from about 0.01 to 0.40 wt %.

8. The process as recited in claim 7 wherein from about 0.2–2.5 wt.% of flame retardant is added to the aqueous suspension.

9. The process as recited in claim 1 wherein said suitable suspending agent system is a finely divided tricalcium phosphate and an anionic surfactant.

10. The process as recited in claim 1 wherein said suitable blowing agent is selected from the group consisting of butane, n-pentane, isopentane, cyclopentane, hexane, carbon dioxide, fluorinated hydrocarbons and mixtures thereof.

11. The process as recited in claim 1 wherein said vinyl aromatic monomer is styrene.

12. A process for preparing a pattern for use in making metal castings, which have significantly less residual carbon on the surface comprising:

(a) adding an amount, effective for the purpose, of a flame retardant selected from the group consisting of hexabromocyclododecane and tetrabromocyclooctane to a vinyl aromatic monomer;

(b) suspending the monomer in water using a suitable suspending agent system;

(c) adding a suitable blowing agent to the partially polymerized suspension and heating to impregnate the particles; and (d) separating the impregnated beads from the aqueous suspension, washing and drying the beads, wherein said surface is selected from the group consisting of bronze, brass, ductile, modular or grey iron, magnesium and steel.

13. The process as recited in claim 12 wherein the resulting polymer has a molecular weight of about 170,000 to 320,000.

14. The process as recited in claim 12 wherein the resulting polymer has a bead size between about 100 to 600 microns.

15. The process as recited in claim 14 wherein the resulting polymer has a bead size between about 250 and 425 microns.

16. The process as recited in claim 12 wherein from about 0.2–2.5 weight % of flame retardant is added to the aqueous suspension.

17. The process as recited in claim 16 wherein said vinyl aromatic monomer is styrene.

18. The process as recited in claim 12 wherein said suitable suspending agent system is a finely divided tricalcium phosphate and an anionic surfactant.

19. The process as recited in claim 12 wherein said suitable blowing agent is selected from the group consisting of butane, n-pentane, isopentane, cyclopentane, hexane, carbon dioxide, fluorinated hydrocarbons and mixtures thereof.

* * * * *